United States Patent [19]

Plowman et al.

[11] Patent Number: 4,732,660

[45] Date of Patent: Mar. 22, 1988

[54] MEMBRANE ELECTROLYZER

[75] Inventors: Keith R. Plowman, Lake Jackson, Tex.; Richard E. Zachary, Clinton, La.

[73] Assignee: The Dow Chemical Company, Midland, Mich.

[21] Appl. No.: 773,900

[22] Filed: Sep. 9, 1985

[51] Int. Cl.[4] ..... C25B 9/00; C25B 11/03; C25B 11/10; C25B 11/12

[52] U.S. Cl. ..... 204/265; 204/266; 204/279; 204/283; 204/294; 204/296; 204/286; 204/290 R; 204/284

[58] Field of Search ..... 204/256, 258, 265, 279, 204/290 R, 266, 283–284, 98, 294, 296, 286, 290 F

[56] References Cited

U.S. PATENT DOCUMENTS

| | | | |
|---|---|---|---|
| 4,331,521 | 5/1982 | Chisholm et al. | 204/98 |
| 4,332,662 | 6/1982 | Pouli et al. | 204/265 |
| 4,377,462 | 3/1983 | Baker et al. | 204/253 |
| 4,435,267 | 3/1984 | Batzold et al. | 204/265 X |
| 4,448,663 | 5/1984 | Dang et al. | 204/270 |
| 4,534,845 | 8/1985 | McIntyre et al. | 204/265 X |
| 4,563,261 | 1/1986 | Staab et al. | 204/290 R |
| 4,584,080 | 4/1986 | Staab et al. | 204/255 |
| 4,586,999 | 5/1986 | Goldsmith et al. | 204/290 R X |
| 4,615,783 | 10/1986 | Staab | 204/266 X |

*Primary Examiner*—Donald R. Valentine
*Attorney, Agent, or Firm*—Andrew E. Pierce

[57] ABSTRACT

An ion exchange membrane electrolyzer having at least one electrolytic cell containing a gas diffusion cathode, a current distributor, an anode supported by a wall of the electrolytic cell housing, and spacing means separating the current distributor which is in contact with said gas diffusion cathode from said ion exchange membrane wherein the force exerted by gas pressure applied to one face of the gas diffusion cathode is transmitted to said anode via said current distributor, and/or said spacing means, and said ion exchange membrane.

8 Claims, 8 Drawing Figures

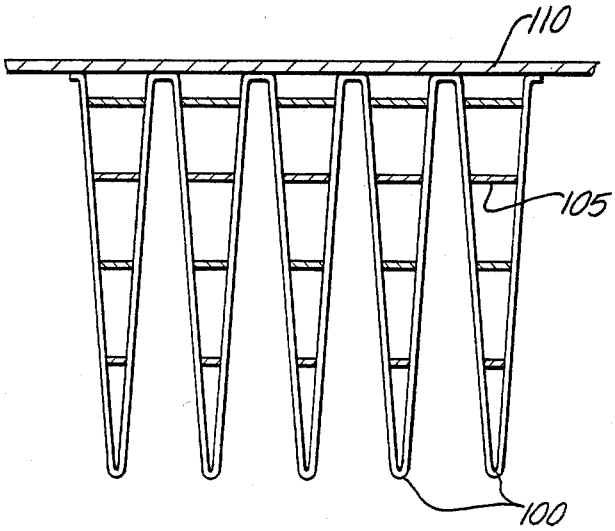
Fig-7
Fig-8
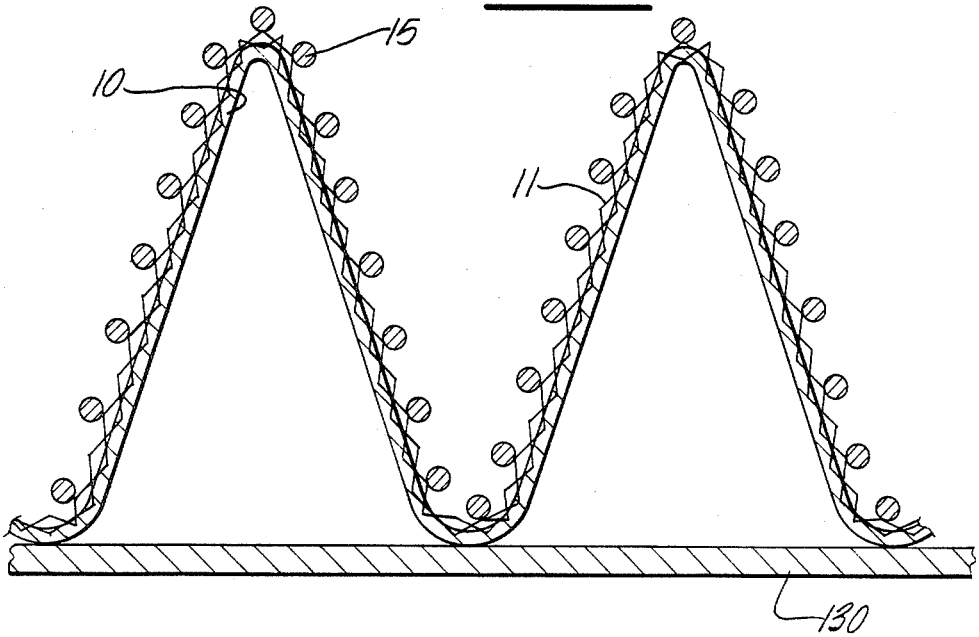

MEMBRANE ELECTROLYZER

BACKGROUND OF THE INVENTION

1. Field of the Invention

This invention relates to electrochemical cells having gas diffusion cathodes and dimensionally stable anodes.

2. Description of the Prior Art

Electrolysis of aqueous alkali metal halides to produce halogen, especially chlorine, in an electrolysis cell provided with an anode and a cathode separated by an ion permeable membrane is well known. In certain of these cells, the electrodes are bonded to and/or embedded in opposite sides of the membrane which is usually a cation exchange fluorocarbon polymer containing sulphonic acid groups or carboxylic groups as disclosed in U.S. Pat. No. 4,331,521.

The electrodes can be dimensionally stable anodes as described in U.S. Pat. No. 3,770,611, and gas diffusion cathodes containing electroconductive particles such as silver or a platinum group metal supported by carbon black or graphite and bonded with a fluorocarbon polymer which also serves to wetproof the carbon or graphite matrix.

The resulting membrane-electrode assembly is mounted in an electrolytic cell in which a substantially saturated aqueous alkali metal halide solution is fed into the anode chamber and water or dilute caustic is fed into the cathode chamber. By establishing an electrical potential between the anode and cathode, chlorine is evolved at the anode and the formation of hydrogen at the gas diffusion cathode is prevented by feeding oxygen or air to the side of the cathode opposite to that which is exposed to the electrolyte. Electrolysis of this type can be conducted at high current densities, on the order of 1,000 to 3,000 amperes per square meter of anode surface and at a voltage which is several hundred millivolts lower than with gas diffusion cathodes not bonded with a fluorocarbon.

One difficulty which is encountered in the operation of such electrolytic cells is the tendency of the gas pressure imposed on the back surface of the cathode to force the cathode against the cell membrane, thus eliminating to a large extent an area for catholyte circulation between the electrode and the cell membrane. When large electrode areas are required in the electrolytic cells, the total force required to constrain the electrode from expanding in the direction of the membrane under the applied pressure of the gas applied to the back side of the cathode is very large. If the electrode curvature must remain small, as is required in flat plate electrolytic cell designs, the stress in the supporting structures of the electrolytic cell becomes very large. Structural supporting devices are required where large electrode surfaces are used even with modest pressure differentials of 2 lbs per square inch or less.

SUMMARY OF THE INVENTION

A membrane electrolyzer is disclosed having at least one electrolytic cell comprising a cell housing divided into two compartments, namely an anode and a cathode compartment, containing respectively an anode and anolyte and a cathode and catholyte, by an ion exchange membrane. A gas diffusion, or gas depolarized cathode utilizing oxygen or air and a dimensionally stable anode are provided wherein the anode is internally supported or is supported by a wall of the electrolytic cell housing. The force exerted by the gas pressure applied to the backface of the cathode, i.e. opposite to that which is exposed to the electrolyte, is transmitted to the anode via the intermediate structures in the cell, namely a current distributor in contact with said cathode, an ion exchange membrane, and spacing means between the ion exchange membrane and said current distributor.

BRIEF DESCRIPTION OF THE DRAWINGS

FIGS. 7 and 8 are schematic vertical cross sections respectively of anode pocket assemblies and a cathode pocket assemblies used in the formation of a pocket type electrolytic cell. In the various Figures, generally like components are similarly numbered.

DETAILED DESCRIPTION OF THE INVENTION

Figure 1:
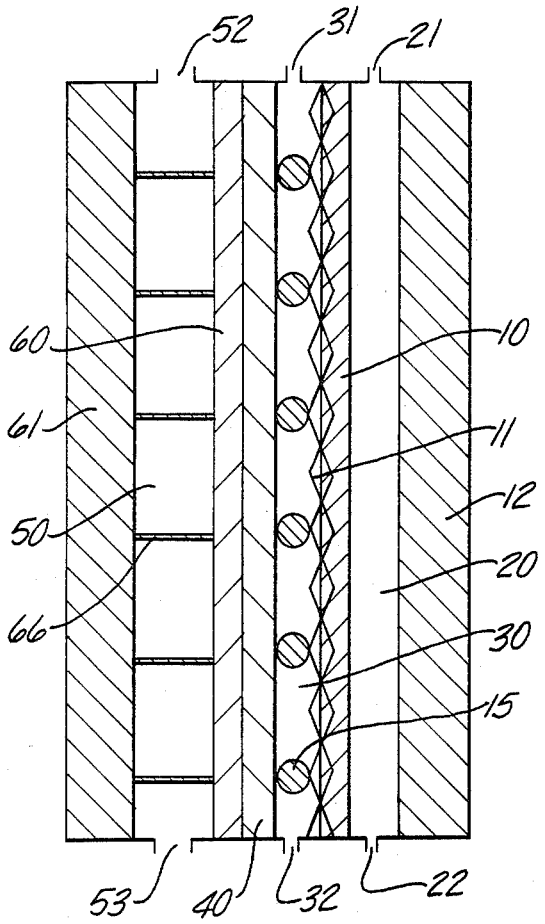
FIG. 1 is a schematic vertical cross sectional view of one embodiment of the invention in a single flat plate type electrolytic cell.

The electrolytic cell of the invention can be a flat plate type electrolytic cell utilizing a single or stacked array of cells. Each cell unit is comprised of an anodic compartment equipped with an anode and a cathodic compartment equipped with a cathode, the compartments being separated by an ion exchange membrane, preferably a cation exchange membrane. In addition to the ion exchange membrane, the anode and cathode of the cell are separated by a spacing means and a current distributor which is in contact with a gas diffusion cathode, the opposite face of which is exposed to a depolarizing gas, such as air or an oxygen containing gas in the case of an oxygen depolarized cathode. The anode is preferably a dimensionally stable anode such as an expanded metal anode or a perforated metal anode having an electrocatalytically active coating on at least one side comprising a mixture of platinum group metal oxides.

The electrolytic cell of the invention is especially suitable for generating halogen by electrolyzing an aqueous halide. The production of hydrogen is avoided by the use of a depolarized cathode which is exposed on one surface to air or oxygen as the depolarizing gas.

The dimensionally stable anode can be coated on both the front face and the back face with an electrocatalytically active coating, however, only one face of the anode need be active. Preferably the face of the anode opposite to that face exposed to the ion exchange membrane is electrocatalytically active.

According to the present invention, there is provided a monopolar cell suitable for use in the electrolysis of an aqueous alkali metal halide solution (hereinafter referred to as brine) to produce an aqueous alkali metal hydroxide solution (hereinafter referred to as cell liquor) and halogen. A bipolar cell design is also envisioned. Hydrogen is not produced in view of the fact that the cathode is a gas depolarized cathode which is depolarized utilizing air or oxygen gas. A cation selective membrane is positioned between the anode and the cathode. The anode plates, cathode plates, and spacing means utilized each have openings which in the cell define separate compartments which provide respectively for inlet brine, an outlet for brine and halogen, an inlet for water or alkaline water, and an outlet for cell liquor.

In a series of electrolytic cells the terminal anode end plate should be sufficiently strengthened to resist the pressure transmitted to the anode as the result of the pressurization by gas of one side of the gas depolarized cathode.

The anode of the monopolar electrolytic cell of the invention can be a dimensionally stable anode in the form of a perforated metal plate or in the form of a sheet of expanded metal. Preferably the expanded metal sheet is formed to have the appearance of louvers. These sheets are conveniently produced from a sheet of metal by pressing or with a slitting and forming tool. The slats of the louvers which are obtained can suitably be turned at right angles to the original plane of the metal sheet or they can be inclined at a lesser angle to this plane, if desired. The louvered slats are preferably inclined at an angle of more than 60° to the plane of the anode sheet. The louvers of each anode are preferably aligned so that their longitudinal axes are parallel to one another. When the anodes are installed in the cell, they are vertically disposed. The evolved gases flow in the channels formed by the louvers of the anode. An electrocatalytically active coating is generally used on the anode. The coating is resistant to electrochemical attack and active in transferring electrons between electrolyte and the anode.

The electrocatalytically active coating can suitably consist of one or more platinum group metals, for instance platinum, rhodium, iridium, ruthenium, osmium, and palladium, or alloys of said metals and/or oxides thereof, or another metal or compound which will function as an anode and which is resistant to electrochemical dissolution in the cell, for instance rhenium, rhenium trioxide, magnetite, titanium nitride, and the borides, phosphides, and silicides of the platinum group metals. The coating can consist of one or more of said platinum group metals. Especially suitable electrocatalytically active coatings according to the invention include platinum itself and those coatings based upon ruthenium dioxide/titanium dioxide, and ruthenium dioxide/tin dioxide/titanium dioxide.

The cathode is characterized as an air or oxygen diffusion or depolarized laminar cathode which comprises a thin porous, electrically conductive, semi-hydrophilic polymer sheet layer containing conductive and particulate carrier material and an electrochemically active catalyst composition. Carbon is the preferred carrier material because of its low cost, but other carrier materials such as finely divided metal powders may be used. The cathode is preferably a laminate consisting of said semi-hydrophilic sheet layer and a thin microporous layer consisting of a fluorocarbon polymer sheet. The electrochemically active catalyst which is applied to the carrier material can be selected from the well known fuel cell catalyst materials. Such catalysts as silver, metals of the platinum group (platinum, palladium, rhodium, ruthenium, osmium, and iridium) can be used. Particulate carbon materials having catalyst deposited thereon are commercially available. The catalyst material can be present in amounts ranging from about 0.5% to about 10% by weight of the carrier material. It is generally preferable to use silver as the catalyst as it provides substantially the same performance as platinum at a considerable cost saving. Methods of preparing such cathodes are well known in the art.

The catalyst composition is also generally bonded with a polymeric, thermoplastic, hydrophobic material which functions as a wet-proofing agent as well as a binder. The purpose of the wet-proofing agent is to prevent electrolyte from completely covering the internal surface area of the depolarized cathode when the cathode is immersed in the aqueous electrolyte. Examples of wet-proofing agents which can be used are halocarbon polymers, silicon resins, or paraffin wax. The wet-proofing agent generally comprises about 5 to about 50 percent by weight of the total catalyst composition, with about 20 to about 30 percent of the wet-proofing agent being preferred.

Generally the thermoplastic halocarbon polymer is selected from the group consisting of at least one of the polymers of tetrafluoroethylene, fluorinated ethylene propylene, copolymers thereof having the moieties $(—CX_1X_2—CX_3CX_4—)$, $(—CY_1Y_2—CY_3Y_4—)$, and homopolymers having the moieties $(CY_1Y_2—CY_2—CY_3F—)$ wherein $X_1$, $X_2$, $X_3$, $X_4$, $Y_1$, $Y_2$, $Y_3$, and $Y_4$ are selected from the group consisting of fluorine, chlorine, and hydrogen, at least one of said X and Y being fluorine. The preferred thermoplastic polymer is a fluorocarbon polymer selected from the group consisting of at least one of copolymers having an ethylene moiety and a fluorocarbon moiety chosen from the group consisting of $(—CFH—CH_2)$, $(—CF_2CH_2—)$, $(—CF_2—CFH—)$, $(CF_2—CF_2—)$, $(—CF_2—CClF—)$.

To one surface of the depolarized cathode there is generally applied a thin, porous, hydrophobic layer of a polymer. Generally the porous hydrophobic polymer layer is laminated to the catalyst containing sheet material of the electrode. The hydrophobic polymer sheet material can be prepared from various fluorocarbon polymers such as polytetrafluoroethylene, polytrifluoroethylene, polyvinylidene fluoride, polytrifluorofluoroethylene, and copolymers thereof. Polytetrafluoroethylene is preferred. Generally the hydrophobic polymer sheet material has a thickness of about 5 to about 20 mils.

Generally, the gas depolarized cathode is laminated to a metal mesh current distributor such as a $20\times20\times0.010$ inch metal mesh. The metal mesh current distributor can be prepared from a metal selected from the group consisting of steel, nickel, platinum group metals, and mixtures thereof. Preferably the metal mesh is prepared from a metal selected from the group consisting of silver or silver-coated steel, and valve metals. The current distributor is preferably laminated to the semi-hydrophilic surface of the gas depolarized cathode which is that surface of the cathode opposite to that to which the thin microporous fluorocarbon polymer sheet material is applied.

The spacing means which separates the membrane and the current distributor can be fabricated from any suitable conducting or non-conducting material such as a synthetic organic polymer which is inert to the conditions prevailing in the cell. A distinct current distributor can be eliminated if a conductive spacing means is used. Especially suitable polymers include polyvinylidene fluoride, polyvinyl chloride, and polypropylene. If the spacing means is also to function as a current distribution device, the material of construction must be metallic and preferably plastic coated on the side in contact with the membrane. For oxygen reduction, the preferred metallic materials are the same as those used for the current collector., i.e., nickel, and silver plated nickel with one side coated with an inert polymer such as teflon, polyvinyl chloride, polyethylene, and the like. The spacing means can be a perforated plastic sheet or a grid of filaments of plastic. The spacing means is provided with an inlet and an outlet for catholyte liquor.

In cell design, the anode and cathode end plates are made sufficiently rigid to provide support against the internal cell pressures. In flateplate cell assemblies with many individual cells only the end plates must have such structural rigidity under normal operating conditions. To guard against problems of distortion which can arise from upset conditions, a rigid structure at about 10 unit cell increments probably is advisable. In bipolar designs and in some monopolar designs requiring individual cell electrolyte isolation, flexable plastic sheet materials can be used rather than structurally rigid materials such as steel or polymer composites. The cell must also be provided with sealing joints or gaskets which are suitably prepared from an elastomeric material, for example natural or synthetic rubber. The sealing joints or gaskets are suitably cut from a sheet of elastomeric material or molded from the elastomeric material and correspond in overall size and shape to the areas of the cathode and anode end plates which are intended to come together to form the electrolytic cell.

Any suitable membrane ion exchange material can be used in the electrolytic cell of the invention. Preferably a porous fluoropolymer based ion exchange membrane can be used (for instance, polytetrafluoroethylene).

A large group of ion exchange membranes suitable for use in the electrolysis of aqueous halide solutions is known to the art. Many of these membranes are fluorocarbon polymers which contain cation exchange groups and are copolymers of tetrafluoroethylene with $CF_2{=}CF{-}O{-}CF_2CF_2SO_3H$ or other corresponding acidic polymerizable fluorocarbon. Such materials comprise long fluorocarbon chains with various acidic groups including sulphonic, phosphonic, sulphonamide, or carboxylic groups or alkali metal salts of said groups attached thereto. Ion exchange sheets of suitable fluorocarbon polymer are supplied by E. I. DuPont under the tradename "NAFION" and by the Asahi Glass Company of Japan under the tradename "FLEMION".

The ion exchange membranes are utilized in the form of thin, air-impermeable sheets having a thickness of about 0.2 to about 1 millimeter. The sheets are impermeable to the mass flow of electrolyte, although some water can transfer during electrolysis. The membranes having predominantly sulphonic or phosphonic groups are relatively strong acids and often absorb 25 to 30 percent by weight of water based upon the dry weight of the polymer. Those membranes which contain predominantly the weaker carboxylic acids absorb less water and therefore expand to a lesser degree when exposed to hot alkali metal hydroxide. The amount of acid groups in these ion exchange membranes varies but generally ranges from about 800 to 2000 in equivalent weight.

In operation the brine passes into the electrolytic cell of the invention through the anolyte inlet. Halogen gas generated in the anolyte compartment passes upwards through the brine feed passages and is collected in overhead common passages. The cell liquor in the form of dilute alkali metal hydroxide exits at the catholyte outlet of the cell. The alkali metal hydroxide cell liquor can be recirculated through the catholyte inlet or, alternatively, water can be fed into the catholyte inlet.

The invention is further illustrated by way of example; embodiments of the invention will now be described with reference to the accompanying drawings.

Figure 2:
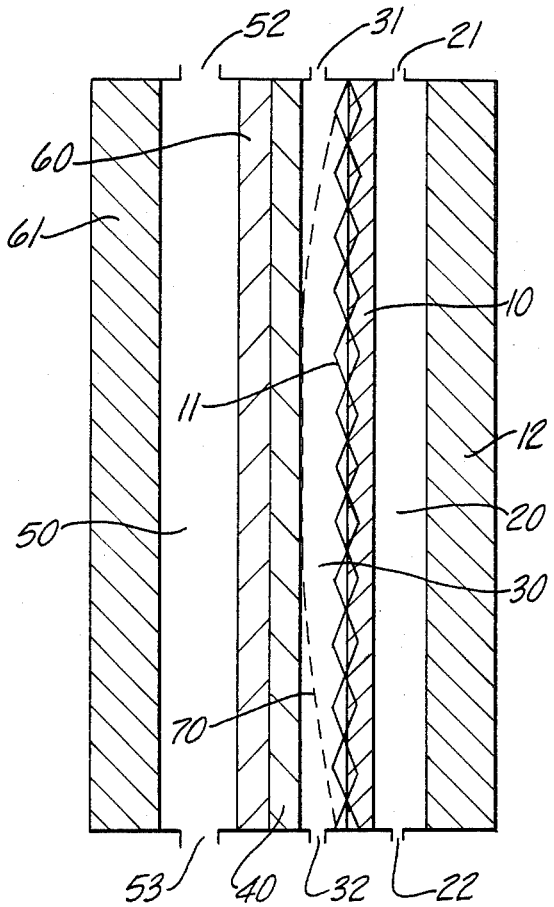
FIG. 2 is a prior art single flat plate type electrolytic cell.

FIG. 1 is a schematic vertical cross-section of two single electrochemical cells showing a preferred embodiment of the invention. FIG. 2 similarly illustrates a prior art single cell. FIG. 1 shows the same cell with an embodiment of the spacing means invention added. The major cell components, as shown in FIG. 1 are a gas diffusion cathode comprised of a polymer bonded carbon composite sheet laminate 10, a current collector 11, an ion exchange membrane 40, a dimensionally stable anode 60, a cathode end plate 12, and an anode end plate 61. An oxygen feed space 20 between the backface of the cathode and the cathode end plate is provided with an oxygen feed port 21 and an oxygen exit port 22. A catholyte compartment 30, between the current collector 11 and membrane 40 is provided with catholyte inlet 32 and catholyte outlet 31 as well as ports for water feed, catholyte recirculation, and product recovery which are not shown. An anolyte compartment 50 formed between the anode 60 and the anode backplate is provided with an anolyte feed port 53 and exit port 52 which is also used for gaseous product recovery. The prior art cell of FIG. 2 contains free standing electrodes and functions well as long as very small gas pressures are employed in the oxygen feed space 20. As the pressure differential in gas space 20 increases, the cathode and current collector move toward the membrane creating a convex shape as indicated by dashed line 70. For closely spaced electrodes, for instance, 3 mm or less spacing, small pressures create unacceptable distortion unless a significant amount of structural metal is used to prevent movement. Such movement eliminates the cathode compartment 30 and thereby prevents proper operation of the electrolysis cell.

In FIG. 1, an embodiment of the spacing means of the invention is shown. Spacer rods 15 maintain a catholyte space. In the anolyte compartment 50 anode support rods 66 is used to support the anode 60 to provide a near rigid anode structure. Upon pressurization of the oxygen feed compartment 20, the cathode is pressed against the spacer rods 15 forcing them against membrane 40 and anode 60. With the addition to the cell of the anode support rods 66, this force is transmitted to the anode end plate 61. With the cell of the invention, structural materials capable of pressure containment are needed only in the cathode and anode end plates, 12 and 61 respectively. Thus structural materials are minimized in the more expensive electrode materials as these components need rigidity only over small distances defined by the spacing rods 15 and the anode support rods 66. In addition, interelectrode spacing is determined by the spacer rods 15 and not by the fabrication precision or the care used in the assembly of other cell components.

Figure 3:
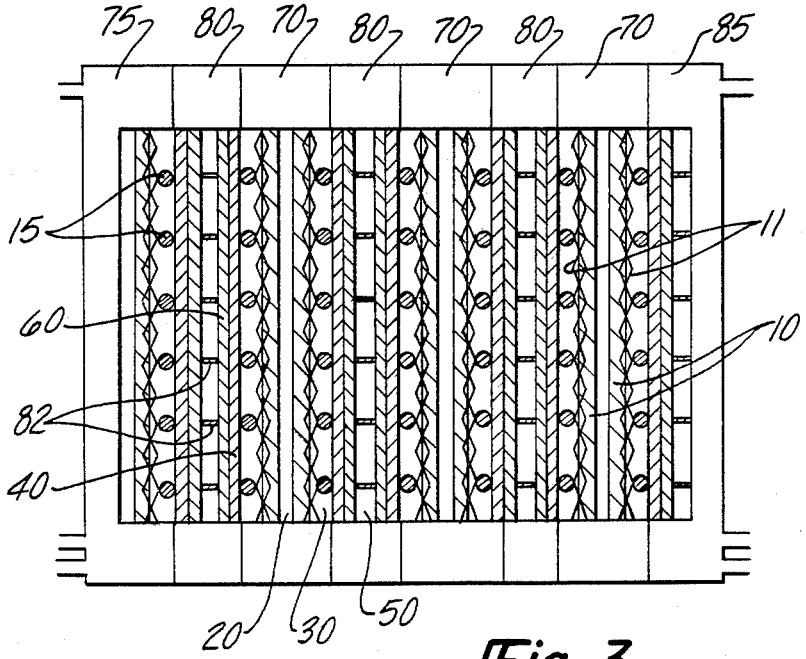
FIG. 3 is a schematic vertical cross sectional view of another embodiment of the invention in a monopolar flat plate cell.
Figure 4:
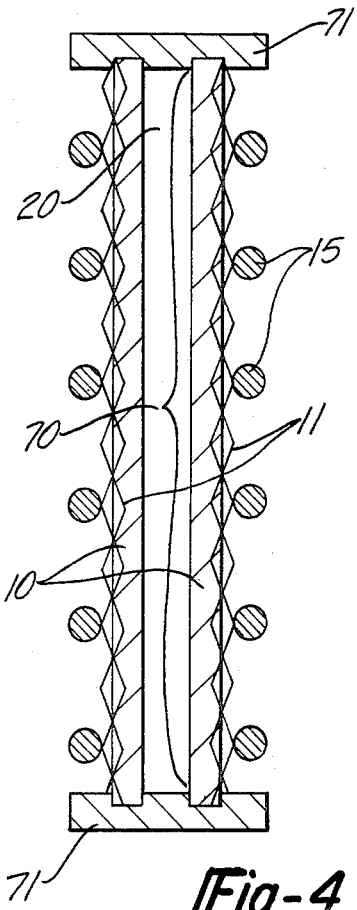
FIGS. 4 and 5 are schematic vertical cross sections respectively of cathode and anode assemblies used to form the flate plate cell of FIG. 3.
Figure 5:
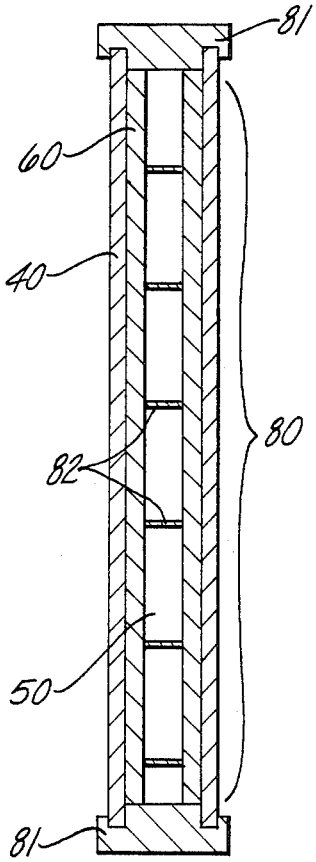

FIG. 3 schematically illustrates a vertical cross section of an embodiment of the invention in a monopolar flat plate cell design. FIG. 4 shows in cross-section a cathode assembly 70. FIG. 5 shows in vertical cross-section an anode assembly 80. These electrode assemblies are used to produce a monopolar cell. The number of units of anode and cathode assemblies is not limited conceptually but in practice will be limited by fluid flow requirements and user needs.

The cathode assembly 70 of FIG. 4 is a gas diffusion cathode, polymer bonded carbon composite sheet laminate 10 having a current collector 11, catholyte spacer rods 15, and cell frame component 71. The cell frame component 71 may be formed from a plastic or composite plastic material and has designed into it the flow channels necessary to transport all cell fluids, anolyte/-gaseous product, catholyte, and oxygen or oxygen containing gas supply.

The anode assembly 80 shown in FIG. 5 consists of an internally supported anode 60, an ion exchange membrane 40, and a cell frame component 81. The anode 80 is preferably a metal oxide catalyst coated expanded titanium mesh. Internal supports 82 may be metal rods or flat metal strips and preferably they are aligned in the direction of current flow from the external cell connector and thereby provide most of the metal material needed for current conduction in the anode. The cell frame component 81 has flow channels, not shown, which are necessary for cell fluids transport.

FIG. 3 schematically illustrates in vertical cross-section a monopolar cell containing multiple cathode assemblies 70 and anode assemblies 80. Electrical connections to anodes and cathodes are not shown but would be made on opposite sides of the cell. The cell end plates 75 and 85 are modified to accept feed and outlet connections for cell fluid flows and must be structurally able to contain full internal cell pressures. Each type of fluid compartment, oxygen 20, catholyte 30, and anolyte 50, is shown. Upon pressurizing the oxygen compartments 20 force against the cathode is transmitted through the catholyte spacer rods 15 and membrane 40 having internal supports 82 to the anodes 60. In this configuration, the forces are balanced and the anode 40 is subjected only to compressive forces. Throughout the cell uniform interelectrode spacing is provided and structural electrode metal requirements are determined by current conduction rather than structural needs. A preferred embodiment of the invention in this application is to use conductive spacer rods consisting of metal rods with a plastic material coating on the anode side of the spacer. With metal rods, for instance, nickel or silver plated nickel, the rods also act as current carrying devices, distributing current to the collector mesh. The spacer rods can be of non-conductive plastic for use with a distinct current collector.

Figure 6:
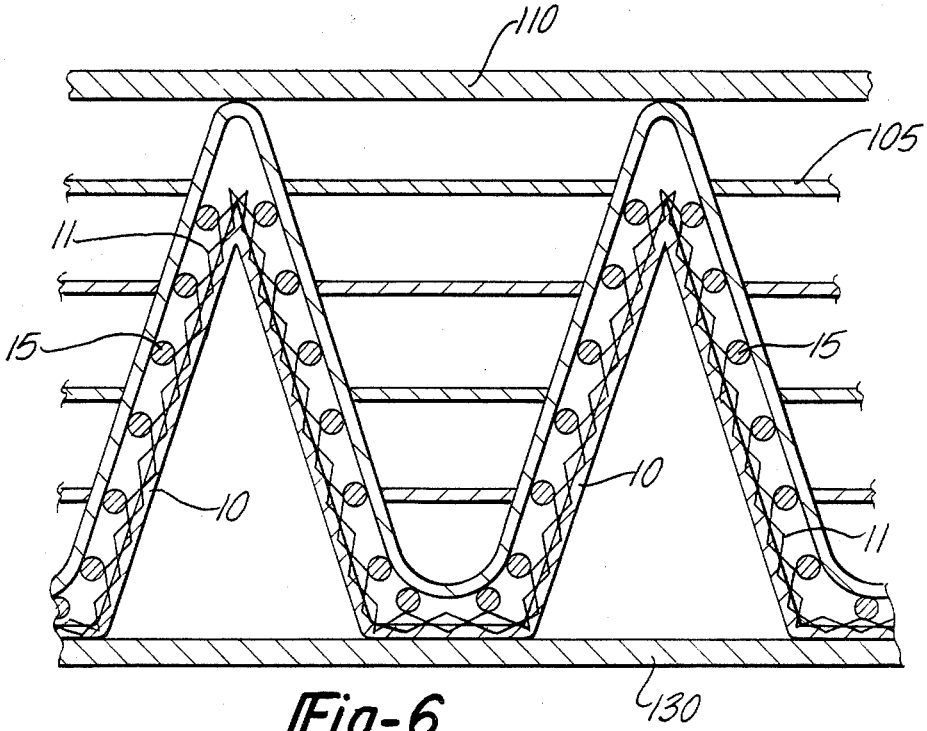
FIG. 6 is a schematic vertical cross sectional view of another embodiment of the invention in a pocket cell.

FIG. 6 schematically illustrates in vertical cross-section an embodiment of the present invention in a pocket cell. FIG. 7 shows an anode pocket assembly including the individual pockets 100 and the backboard 110. Each of the anode pockets is internally reinforced with metal strips 105 running in the direction of current flow in the anode (not shown in this drawing) and contains holes to allow gas evolution. Metal strips 105 function as internal supports as well as current conductors. The cell membrane preferably is not attached to the individual pockets but is a ribbon, shaped to conform to the anode and cathode assemblies and sealed into its own assembly (not shown). Thus, a pocket cell consists of a membrane assembly, a cathode pocket assembly, and an anode pocket assembly. Solution feeds and product recovery ports are designed into the membrane assembly.

FIG. 8 schematically shows in vertical cross section a cathode pocket assembly with individual pockets 120 on a cathode backboard 130. The individual pockets consist of the same components as shown in FIG. 4, a gas diffusion cathode 10, a current collector 11, and catholyte spacer rods 15. The prefered rods 15 are metallic and aligned in the direction of current flow, so that both current distribution and spacing functions are fulfilled. The current collector 11 is a screen or expanded metal and is in conductive contact with spacer rods 15. The spacer rods are themselves in electrical contact with the cathode backboard 130. Finally, the polymer bonded diffusion cathode material 10 is inserted and sealed into the individual pockets with pocket ends previously sealed.

FIG. 6 schematically shows in vertical cross section the electrode assemblies meshed as they would be in the pocket cell. The cell membrane material is not shown but would line the area between anode and cathode assemblies. The oxygen compartment 20 is formed by the "pouch" configuration of the polymer bonded cathode material and is common at the backboard 130. The anolyte compartment 50 is formed by the anode pocket structure and has common feed and exit ports (not shown) above and below the electrode assemblies within the membrane assembly. The catholyte compartment 30 is defined by the spacer rods 15 and is common to all pockets in the membrane assembly where entry and exits ports are found. As in the flat plate monopolar design of FIG. 2, upon pressurization the anode pockets are subjected only to compresive forces because they are supported with internal support materials 105. High precision of construction is not needed to define uniform interelectrode spacing. Limited expansion of the cathode pocket upon pressurization as the result of the use of the spacer rods ensures uniform and easily defined electrode spacing.

The following example illustrates the various aspects of the invention but is not intended to limit its scope. Where not otherwise specified throughout this specification and claims, temperatures are given in degrees centigrade, and parts, percentages, and proportions are by weight.

EXAMPLE I

Process Demonstration

The use of the anode for pressure containment, was demonstrated in a chlor-alkali cell with 30 square inches of electrode area. FIG. 1 shows schematically the cell configuration. The anode was a ruthenium oxide coated titanium mesh (DSA) from which the coating was removed on the surface in contact with the cell membrane. The cell permselective membrane was Nafion 324 (E. I. DuPont). The catholyte spacer rods were 1/16 inch diameter nickel rods covered by ⅛ inch diameter polytetrafluoroethylene tubing. These rods were orientated vertically in the cell and were spaced apart ¾ inch. The current collector was expanded nickel (10Ni12-2/0, Exmet Corporation) plated with a 10 micron coating of silver. The cathode was a teflon-bonded carbon (silver catalyst) gas diffusion sheet electrode fabricated in a proprietary manner. A cathode compartment, between the cathode current collector and the membrane, was maintained by a ⅛ inch spacer around the periphery of the cell combined with the spacing rods. Cell end plates were as follows. The cathode end plate was a ½ inch thick polyvinyl chloride sheet into which oxygen feed and exit ports were made. The anode plate was titanium with brine feed and exit ports and means for removing the chlorine cell product. Means for catholyte water feed, circulation, and removal were made through design of the cathode end plate and catholyte spacer.

The cell was operated for 150 days to test cell membrane stability and design features. Operating conditions were: temperature, 85° C.; anolyte salt concentration, 180 grams/liter (300 grams/liter feed); catholyte sodium hydroxide concentration, 150 grams/liter average; cell current, 15 amperes (0.5 amperes/square inch); and catholyte recirculation rate, 5 times catholyte water feed rate. Oxygen feed was maintained at 2 psig with a small purge for operational stability. On cell assembly the anode was pressed gently against the membrane and upon pressurization of the oxygen compartment, the cathode expanded toward the anode. Expansion is arrested by the anode through the intermediate catholyte spacer bars. Final anode catholyte spacing was 0.14 inches (3.6 mm) and corresponds to the sum of the spacer rod diameter plus the membrane thickness. The average spacing is somewhat smaller due to bowing of the cathode material between the rods.

Experimental results are shown in Table I. Over the course of the experiment cell voltage averaged 1.90 volts, current efficiency averaged 86.9% at an average NaOH concentration of 150 grams/liter. These average values of voltage and current efficiency give cell power usage of 665 KWH/ECU ton (1330 KWH for one ton of NaOH and one ton of chlorine). Catholyte salt concentrations were also very low, averaging approximately 9 ppm over the course of the experiment. Highly efficient cell performance was observed and no detrimental effects on the cell membrane were observable.

TABLE I

| Operating Time (Days) | Cell Voltage (V) | NaOH Conc. (grams/liter) | Current Efficiency (%) | Catholyte Salt (ppm) |
|---|---|---|---|---|
| 14 | 1.88 | 134 | 86 | — |
| 24 | 1.89 | 165 | 85 | 8 |
| 53 | 1.93 | 130 | 87 | 8 |
| 65 | 1.76 | 131 | 86 | — |
| 95 | 2.01 | 250 | 77 | — |
| 119 | 1.90 | 166 | 94 | 10 |
| 141 | 1.92 | 109 | 93 | — |

While this invention has been described with reference to certain specific embodiments, it will be recognized by those skilled in the art that many variations are possible without departing from the scope and spirit of the invention, and it will be understood that it is intended to cover all changes and modifications of the invention disclosed herein for the purposes of illustration which do not constitute departures from the spirit and scope of the invention.

The embodiments of the invention in which an exclusive property or privilege is claimed are defined as follows:

1. A membrane electrolyzer having at least one electrolytic cell having elements comprising:

(A) a cell housing divided into two compartments, an anode compartment containing an anode and anolyte and a cathode compartment containing a cathode and catholyte, said compartments separated by an ion exchange membrane, (B) a gas diffusion polymer cathode having current distributing means, (C) an internally supported anode or said anode supported by an endplate of said anode compartment, and (D) spacing means in said cathode compartment adjacent to said ion exchange membrane, wherein the force exerted by gas pressure applied to said gas diffusion cathode is transmitted to said anode by cell elements comprising said spacing means and said ion exchange membrane.

2. The membrane electrolyzer of claim 1 wherein said spacing means is electrically conductive and functions as a current distributor and said membrane electrolyzer contains a gas diffusion laminar cathode having (A) an electrically conductive, porous, hydrophilic layer comprising a conductive carbon and a polymeric binder therefor and (B) a porous, hydrophobic layer comprising a hydrophobic polymer and wherein said anode is a dimensionally stable anode comprising a perforated or expanded metal coated on at least part of one side with an electrocatalytically active coating, and wherein said ion exchange membrane is a cation exchange membrane comprising a fluorocarbon ion exchange polymer having sulphonic, phosphonic, or carboxylic acid groups.

3. The membrane electrolyzer of claim 2 wherein said polymeric binder and said hydrophobic polymer comprise a thermoplastic halocarbon polymer, said dimensionally stable anode is coated with a platinum group metal or oxide or alloy thereof, and said spacing means comprises a plastic covered metal rod.

4. The membrane electrolyzer of claim 3 wherein said polymeric binder and said thermoplastic halocarbon polymer is selected from the group consisting of at least one of the polymers of tetrafluoroethylene, fluorinated ethylene propylene, copolymers thereof having the moieties $(-CX_1X_2-CX_3CX_4-)$, $(-CY_1Y_2-CY_3Y_4-)$, and homopolymers having the moieties $(CY_1Y_2-CY_2-CY_3F-)$ wherein $X_1$, $X_2$, $X_3$, $X_4$, $Y_1$, $Y_2$, $Y_3$, and $Y_4$ are selected from the group consisting of fluorine, chlorine, and hydrogen, at least one of said X and Y being fluorine and wherein said dimensionally stable metal anode is made of titanium or an alloy of titanium, and said electrocatalytically active coating is a mixture of ruthenium dioxide and titanium dioxide and said spacing means comprises a nickel rod covered with polytetrafluoroethylene.

5. The membrane electrolyzer of claim 4 wherein said thermoplastic halocarbon polymer is a fluorocarbon polymer selected from the group consisting of at least one of copolymers having an ethylene moiety and a fluorocarbon moiety chosen from the group consisting of $(-CFH-CH_2)$, $(-CF_2CH_2-)$, $(-CF_2-CFH-)$, $(CF_2-CF_2-)$, $(-CF_2-CClF-)$.

6. The membrane electrolyzer of claim 1 wherein said cell comprises a metal mesh current distributor and said spacing means is electrically non-conductive.

7. The membrane electrolyzer of claim 6 wherein said metal mesh current distributor comprises a metal selected from the group consisting of steel, nickel, platinum group metals, valve metals, and mixtures thereof and wherein said spacing means is a synthetic organic polymer selected from the group consisting of at least one of polyvinylidene fluoride, polyvinyl chloride, polyethylene, and polypropylene.

8. The membrane electrolyzer of claim 7 wherein said current distributor metal mesh is prepared from a material selected from the group consisting of silver, silver-coated iron, silver-coated steel, and silver-coated valve metals and wherein said ion exchange membrane is a fluorocarbon polymer having sulphonic acid groups and is a copolymer of tetrafluoroethylene with $$CF_2{=}CF{-}O{-}CF_2CF_2{-}SO_3H.$$

* * * * *

UNITED STATES PATENT AND TRADEMARK OFFICE

CERTIFICATE OF CORRECTION

PATENT NO. : 4,732,660

DATED : March 22, 1988

INVENTOR(S) : Keith R. Plowman; Richard E. Zachary

It is certified that error appears in the above-identified patent and that said Letters Patent is hereby corrected as shown below:

Col. 2, line 21, "flate" should read -- flat --.

Col. 5, line 17, "flateplate" should read -- flat plate --;
line 24, "flexable" should read -- flexible --.

Col. 7, lines 37-38, delete "having internal supports 82";
line 39, "40" should read -- 60 -- and insert -- having internal supports 82 -- immediately thereafter.

Col. 8, line 6, "prefered" should read -- preferred --;
line 31, "compresive" should read -- compressive --.

Signed and Sealed this

Eleventh Day of October, 1988

*Attest:*

DONALD J. QUIGG

*Attesting Officer*

*Commissioner of Patents and Trademarks*